US010130862B2

(12) United States Patent
Gribble et al.

(10) Patent No.: US 10,130,862 B2
(45) Date of Patent: Nov. 20, 2018

(54) METHOD AND APPARATUS FOR AN ATHLETIC TRAINING AID

(71) Applicant: Antick, LLC, Tempe, AZ (US)

(72) Inventors: Anthony Gribble, Tempe, AZ (US); William Erick Brown, Scottsdale, AZ (US)

(73) Assignee: Antick, LLC, Tempe, AZ (US)

( * ) Notice: Subject to any disclaimer, the term of this patent is extended or adjusted under 35 U.S.C. 154(b) by 263 days.

(21) Appl. No.: 15/058,392

(22) Filed: Mar. 2, 2016

(65) Prior Publication Data

US 2016/0260348 A1 Sep. 8, 2016

Related U.S. Application Data

(60) Provisional application No. 62/127,475, filed on Mar. 3, 2015.

(51) Int. Cl.
*A63B 69/00* (2006.01)
*A63B 71/06* (2006.01)

(52) U.S. Cl.
CPC ..... *A63B 69/00* (2013.01); *A63B 71/06* (2013.01); *A63B 2071/0694* (2013.01); *A63B 2210/50* (2013.01)

(58) Field of Classification Search
None
See application file for complete search history.

(56) References Cited

U.S. PATENT DOCUMENTS 6,467,179 B1 * 10/2002 Wolf ..... B43L 7/027 33/465
6,880,261 B1 * 4/2005 Abbey ..... E04G 21/1833 33/1 G
2004/0006878 A1 * 1/2004 Grove ..... A41H 1/02 33/17 R
2006/0090360 A1 * 5/2006 Shapiro ..... B43L 7/10 33/473
2010/0319208 A1 * 12/2010 Williams ..... G01B 3/14 33/535

* cited by examiner

*Primary Examiner* — Jason Yen
(74) *Attorney, Agent, or Firm* — The Noblitt Group, PLLC

(57) ABSTRACT

The present technology may relate to an athletic training aid to assist in training a user to perform tasks. Various embodiments of the athletic training aid may comprise a body section having a plurality of pivot points disposed between a first end of the body section and a second end of the body section. The plurality of pivot points may be configured to form the body section into a first shape. A coupling device may be configured to couple a first segment of the body section to a second segment of the body section. The coupling device may be configured to couple a first pivot point to a second pivot point to allow the second segment to rotate with respect to the first segment. The coupling device may further comprise a through hole to create an opening through the first and second pivot points.

17 Claims, 4 Drawing Sheets

METHOD AND APPARATUS FOR AN ATHLETIC TRAINING AID

CROSS-REFERENCES TO RELATED APPLICATIONS

This application claims the benefit of U.S. Provisional Patent Application No. 62/127,475, filed Mar. 3, 2015, and incorporates the disclosure of the application by reference.

BACKGROUND OF INVENTION

Certain activities and sports may involve the user performing a task or series of tasks in a certain specific manner. For example, a user may be requested to move in a certain specific manner during a game of football. Users who are unfamiliar with the game of football may not be able to receive sufficient instructions from only words and/or actions. In some cases, the user may require the assistance of a visual aid (i.e., the athletic training aid) to show them the manner in which the task is to be performed. The athletic training aid may provide a visual reference to the user as they are performing the task. The athletic training aid may be configured into various different shapes so that the user may familiarize themselves with the various moves.

SUMMARY OF THE INVENTION

The present technology may relate to an athletic training aid to assist in training a user to perform tasks. Various embodiments of the athletic training aid may comprise a body section having a plurality of pivot points disposed between a first end of the body section and a second end of the body section. The plurality of pivot points may be configured to form the body section into a first shape. A coupling device may be configured to couple a first segment of the body section to a second segment of the body section. The coupling device may be configured to couple a first pivot point to a second pivot point to allow the second segment to rotate with respect to the first segment. The coupling device may further comprise a through hole to create an opening through the first and second pivot points.

BRIEF DESCRIPTION OF THE DRAWINGS

A more complete understanding of the present invention may be derived by referring to the detailed description when considered in connection with the following illustrative figures. In the following figures, like reference numbers refer to similar elements and steps throughout the figures.

DETAILED DESCRIPTION OF EXEMPLARY EMBODIMENTS

Figure 1A:
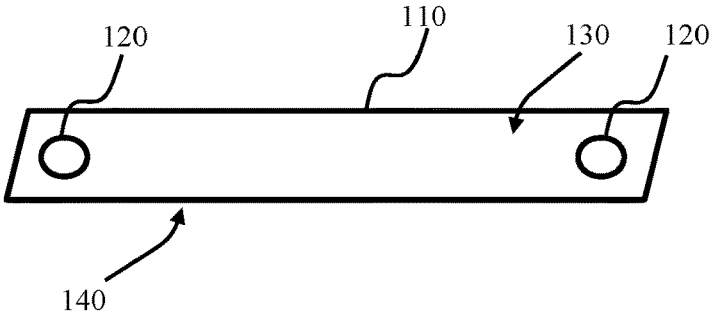
FIG. 1A representatively illustrates a body segment of an exemplary athletic training aid.
Figure 1B:
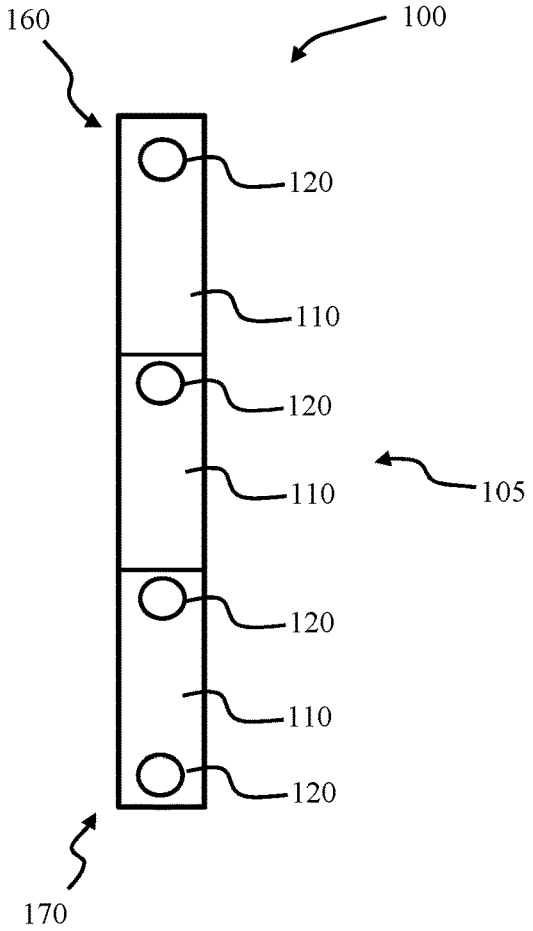
FIGS. 1B-C representatively illustrate a plurality of body segments coupled together to form the athletic training aid.
Figure 1C:
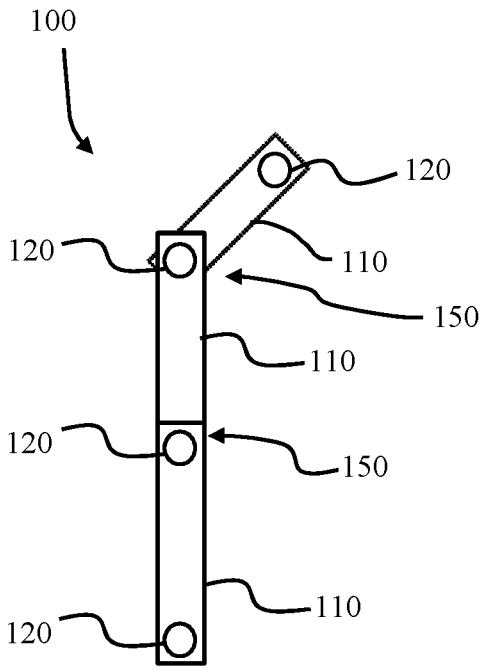

The present technology may be described in terms of functional block components and various processing steps.

Such functional blocks may be realized by any number of components configured to perform the specified functions and achieve the various results. For example, the present technology may employ various types of materials, connectors, and/or anchors for manufacturing an athletic training aid. In addition, the present technology may be practiced in conjunction with any number of physical activities, and the system described is merely one exemplary application for the technology.

Methods and apparatus for an athletic training aid according to various aspects of the present technology may operate in conjunction with any suitable surface such as dirt, grass, ice, snow, water, or synthetic surfaces. Various representative implementations of the present technology may be applied to any system for athletic training or aid.

Referring now to FIG. 1A-D, in one embodiment, an athletic training aid 100 may comprise a body section 105 having a plurality of smaller body segments 110, each having a first end 160 and a second end 170. The plurality of smaller body segments 110 may be coupled together at a pivot point 120 located along at least one of the first end 160 and the second end 170 of each of the plurality of body segments 110. Once any two smaller body segments 110 have been coupled together, the pivot point 120 may allow any one of the two smaller body segments 110 to be rotated about the pivot point 120 to form the athletic training aid 100 into a first shape. Complex shapes or routes may be formed by coupling multiple smaller body segments 110 together.

The entire body section 105 and/or individual smaller body segments 110 may comprise any suitable material configured to be physically altered and/or interacted with. The body section 105 and/or body segments 110 may comprise a flexible material, a rigid material, and/or a combination of flexible and rigid materials. For example, the body section 105 and/or body segments 110 may comprise any suitable material or combination of materials such as plastics, fabrics, composites, metals, woods, and/or the like. The body section 105 and/or smaller body segments 110 may also be configured to withstand repeated physical interactions with a user. In one representative embodiment, the body section 105 and/or body segments 110 may be utilized as an athletic training aid 100 to train users how to run a specific route in a game of football. In this context, the user may be required to physically run over, on, and/or otherwise have direct contact with the athletic training aid 100. If the material comprising the athletic training aid 100 is too thick or rigid, then it may interfere with the user's ability to utilize the athletic training aid 100. For example, the body section 105 and/or smaller body segments 110 may comprise a webbing material of between about one inch and about seven inches in width, wherein the webbing material is configured to have sufficient flexibility and durability to withstand being run on by the user. Further, each smaller body segment 110 may comprise a length of between about four inches and about thirty inches.

The length of each smaller body segment 110 may be equal to the other smaller body segments 110 or the length of the smaller body segments 110 may vary. For example, in one embodiment, the body section 105 may comprise ten smaller body segments 110. Of the ten smaller body segments 110, between one and eight other smaller body segments 110 may comprise a first length and the remaining smaller body segments 110 may comprise a second length that is different from the first length.

The smaller body segments 110 may be coupled together in any desired arrangement or order. For example, all smaller body segments 110 having the same length may be grouped together in a linear manner or the smaller body segments 110 may be coupled together in an alternating manner. The body section 105 may further be configured to allow the user to selectively couple individual smaller body segments 110 together at the pivot point 120 to provide the user with control over the overall length of the body section 105 and the arrangement of each individual length of the smaller body segments 110 making up the body section 105.

In one embodiment, the body section 105 and/or body segments 110 may comprise an upper surface 130 and a lower surface 140. The upper surface 130 and the lower surface 140 may comprise the same material or they may comprise separate materials. For example, after the body section 105 and/or body segments 110 is formed, a material may be affixed or otherwise coupled to the body section 105 and/or body segments 110 to form the upper surface 130 or lower surface 140 of the athletic training aid 100. The affixed material may be configured to be selectively coupled to the upper surface 130 or lower surface 140 such as snaps, zippers, hook and loop fasteners, or any like mechanical attachment.

For example, the upper surface 130 may comprise one or more colors adhered to the body section 105, with each color representing a specific task that needs to be performed and/or to differentiate a first training aid 100 from a second training aid 100. The upper surface 130 may also comprise markings, indicators, and/or other graphics such as arrows or other markers (not shown) that direct the user in a particular direction or direct the user to perform a specific task (e.g., stop, sprint, spin, move to another athletic training aid 100, etc.). The body section 105 and/or body segment 110 may be configured such that the athletic training aid 100 may be used in a variety of environments (e.g., grass, dirt, ice, etc.) and for a variety of tasks (e.g., running receiving routes, conditioning drills, obstacle courses, etc.).

In one embodiment, the lower surface 140 of the body section 105 and/or body segment 110 may be suitably configured to keep the athletic training aid 100 substantially stationary and/or affixed to a surface while being used. Depending on the condition of the surface on which the athletic training aid 100 is placed, various systems and devices may be utilized. The athletic training aid 100 may be utilized in a variety of environmental conditions, including but not limited to grass, turf, sand, dirt, gravel, ice, water, snow, and/or the like.

In another example, in aquatic environments, the lower surface 140 of the body section 110 may be suitably configured to allow the athletic training aid 100 to float on the surface of the water. For example, the athletic training aid 100 may comprise a light-weight buoyant material such as plastic or rubber which allows the athletic training aid 100 to float near the surface.

In one embodiment, each body section 105 and/or body segment 110 may comprise a plurality of pivot points 120. The pivot points 120 may be disposed along any portion of the body section 105 and/or body segment 110. The pivot points 120 may comprise any suitable system or device configured to allow a first body section 105 and/or body segment 110 to pivot in relation to another body section 105 and/or body segment 110. In one embodiment, the pivot points 120 may comprise a circular section cut out or otherwise removed from the body section 105 and/or body segment 110. The pivot points 120 of a first body section 105 and/or body segment 110 may be configured to correspond to the pivot points 120 of a second body section 105 and/or body segment 110 via a coupling device 150.

Figure 1D:
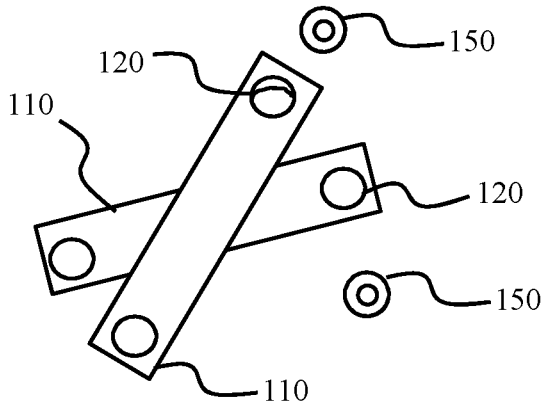
FIG. 1D representatively illustrates a coupling device used to couple a first body segment of the athletic training aid to a second body segment of the athletic training aid.

Now referring to FIG. 1D, in one embodiment, the coupling device 150 may comprise any suitable system or device configured to hold two objects together such that the objects may pivot and/or otherwise rotate with respect to each other. For example, in one embodiment, the coupling device 150 may comprise a grommet. A first piece of the grommet may be inserted into the pivot point 120 of a first body section 105 and/or body segment 110. A second piece of the grommet may be inserted into the pivot point 120 of a second body section 105 and/or body segment 110. The first and second pieces of the grommet may then be connected together coupling the first body section 105 and/or body segment 110 to a second body section 105 and/or body segment 110 at the pivot point. The first and second pieces of the grommet, when coupled together, may comprise a through hole 180 to create an opening through the first and second pivot points of the first and second body sections 105 and/or body segments 110.

Figure 2A:
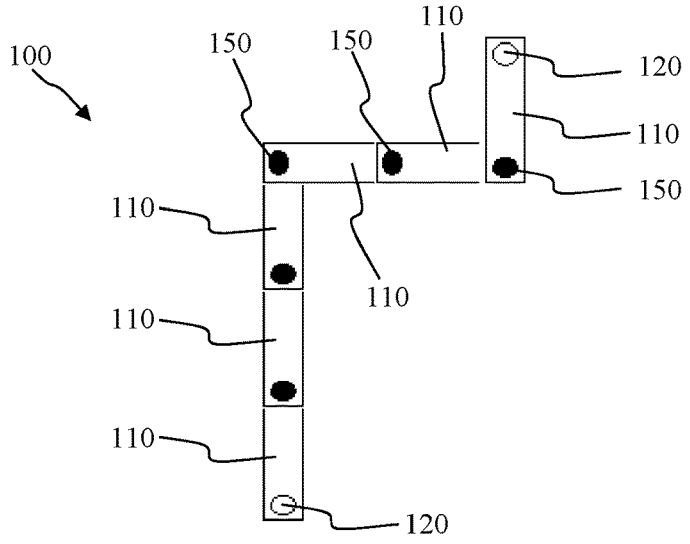
FIGS. 2A-B representatively illustrate the athletic training aid being configured into various shapes.
Figure 2B:
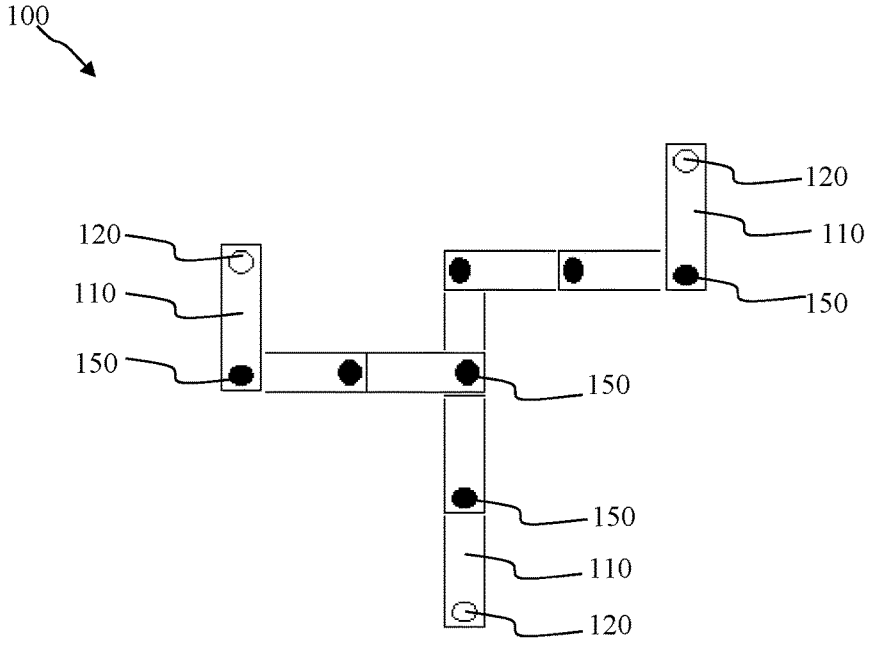

Now referring to FIGS. 2A-B, in one embodiment, the athletic training aid 100 may be configured into a first shape (in this case, the athletic training aid 100 is configured into the shape of a football post route). A first section 401 of the athletic training aid 100 may be configured to be in a substantially straight line to indicate a first portion of the post route. A second section 402 of the athletic training aid 100 may be configured to be slanted relative to the first section 401 to indicate a second portion of the post route. The pivot point 120 between the first section 401 and the second section 402 allows the rotation of the first section 401 relative to the second section 402. In addition to the first and second sections 401, 402, the athletic training aid 100 may comprise multiple additional sections depending on the shape the athletic training aid 100 is needed to show. For example, a hook route or double move route, as shown in FIG. 2B, may require multiple sections of the athletic training aid 100 to be configured into various shapes. To facilitate this, each individual body section 105 and/or body segment 110 may be configured to rotate with respect to each other body section 105 and/or body segment 110.

Now referring back to FIGS. 1A-D in one embodiment, the coupling device 150 may be configured to couple together multiple athletic training aids 100 into a singular athletic training aid 100. For example, the multiple athletic training aids 100 may be coupled together via the coupling device 150 at a single pivot point 120. In another example, multiple athletic training aids 100 may be coupled together at different pivot points. A first athletic training aid 100 may be configured to teach the user how to run a particular route. The first athletic training aid 100 may have a second athletic training aid 100 branching out at any point along the length of the body section 105 and/or body segment 110. For example, a first athletic training aid 100 may branch out into a second athletic training aid 100 at a certain distance (D1) along the length of the body section 105 and/or body segment 110. A third athletic training aid 100 may branch out from the first athletic training aid 100 at a second distance (D2) along the length of the body section 105 and/or body segment 110.

Incorporating multiple athletic training aids 100 into a single athletic training aid 100 may allow multiple users to use the aid for multiple purposes. For example, given a group of players, some may only practice running a first route while others may only practice running a second route. Allowing the possibility for multiple routes for any single given athletic training aid 100 may allow more players to participate in training at the same time, reduce set up time, and requires less space since multiple players are using the same athletic training aid 100.

In another embodiment, the coupling device 150 may comprise any other suitable system or device configured to couple a first athletic training aid 100 to a second athletic training aid 100 and so on. For example, the coupling device 150 may comprise clips, ties, fasteners, adhesives, magnets, and the like. The coupling device 150 may be configured differently depending on the environment in which the athletic training aid 100 is deployed. For example, the coupling device 150 may comprise a more sturdy material such as metal when the athletic training aid 100 is subjected to physical stress such as being run over. If the athletic training aid 100 is used in an aquatic environment, the coupling device 150 may comprise a material that would allow the athletic training aid 100 to float such as lightweight rubbers or plastics.

Figure 3A:
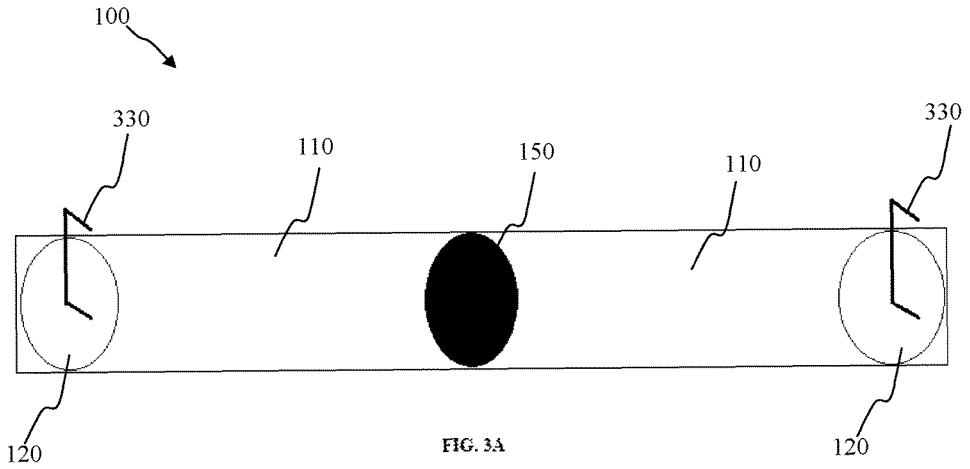
FIGS. 3A-B representatively illustrate the athletic training aid being secured to a surface using a stabilizer.
Figure 3B:
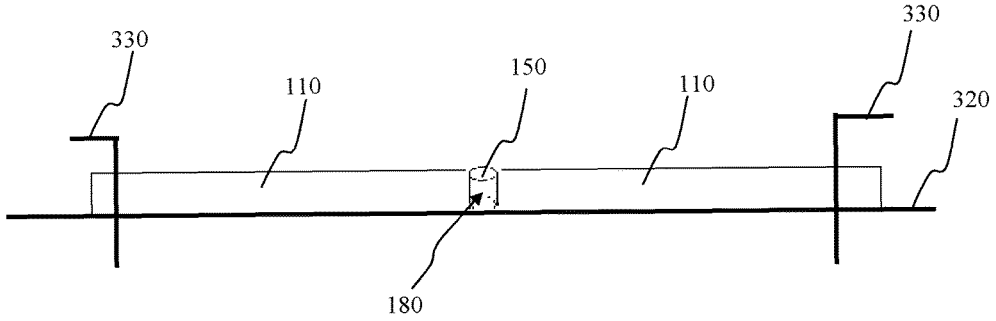

Referring now to FIG. 3, in one embodiment, the pivot points 120 may also be configured to allow the athletic training aid 100 to be secured to the surface on which it is being used and/or to another athletic training aid 100. In one embodiment, the athletic training aid 100 may be secured to a surface 320 by inserting a stabilizer 330 through the through hole 180 one or more of the pivot points 120 and into the surface 320. The stabilizer 330 may be configured to be detachably coupled to at least one of the pivot points 120 of the first body section 105 and/or body segment 110 and/or the second body section 105 and/or body segment 110. The stabilizer 330 may be configured to secure the body section 105 and/or body segment 110 to a surface For example, if the athletic training aid 100 is used to teach football players how to run receiving routes, the athletic training aid 100 may be placed on the ground 320 (e.g., grass, dirt, etc.), and then a stabilizer 330 may be threaded through the through hole 180 of the pivot point 120 and into the ground 320 thereby securing the athletic training aid 100 to the ground 320.

In one embodiment, the stabilizer 330 may comprise any system or device suitably configured to secure the athletic training aid 100 onto a surface 320. The stabilizer 330 may comprise any material such as metals, plastics, rubbers, composites, and the like. For example, the stabilizer 330 may comprise a metal stake or staple that may be passed through the pivot point 120 of one or more body sections 110 of the athletic training aid 100 and into the ground 320. One end of the stake may be used to secure the athletic training aid 100 to the surface 320 and prevent it from leaving or otherwise shifting around on the surface 320.

In other embodiments, various stabilizers 330 may be used depending on the context in which the athletic training aid 100 is used. For example, multiple stakes may be used to secure the athletic training aid 100 on a grassy or dirt surface. In an aquatic setting, weights may be placed on a line and hung from the pivot point 120 to create an anchor to keep the athletic training aid 100 in place on the surface of the water.

The particular implementations shown and described are illustrative of the invention and its best mode and are not intended to otherwise limit the scope of the present invention in any way. Indeed, for the sake of brevity, conventional manufacturing, connection, preparation, and other functional aspects of the system may not be described in detail. Furthermore, the connecting lines shown in the various figures are intended to represent exemplary functional relationships and/or steps between the various elements. Many alternative or additional functional relationships or physical connections may be present in a practical system.

In the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The invention claimed is:

1. An athletic training aid, comprising:

a body section, comprising:

at least three body segments coupled end-to-end;

a plurality of pivot points disposed between a first end of the body section and a second end of the body section, wherein:

a first body segment is coupled to a second body segment at a first pivot point;

the second body segment is coupled to a third body segment at a second pivot point;

the plurality of pivot points allow each individual body segment to be selectively rotated relative to another individual body segment to form the body section into a first shape;

a first coupling device coupling a first end of the first body segment to a first end of the second body segment of the body section to form the first pivot point; and a second coupling device coupling a second end of the second body segment to a first end of the third body segment of the body section to form the second pivot point, wherein each coupling device comprises a through hole.

2. The athletic training aid of claim 1, further comprising a stabilizer configured to:

be detachably coupled to at least one of the pivot points; and secure the body section to a surface.

3. The athletic training aid of claim 2, wherein the stabilizer comprises a garden staple.

4. The athletic training aid of claim 1, wherein the body section comprises a flexible material.

5. The athletic training aid of claim 4, wherein the flexible material comprises a fabric.

6. The athletic training aid of claim 1, wherein:

the first body segment comprises a first length; and the second body segment comprises a second length that is different from the first length.

7. The athletic training aid of claim 1, wherein the first and second coupling device comprises a grommet.

8. The athletic training aid of claim 1, wherein the body section further comprises an upper surface and a lower surface, wherein at least one of the upper surface and the lower surface comprises a set of markings.

9. An athletic training aid, comprising:

at least three body segments, wherein each body segment comprises:

an upper surface and a lower surface;

a first end;

a second end; and a first pivot point disposed at the first ends; and a second pivot point disposed at the second end; and a first coupling device configured to couple a first body segment to a second body segment at one of the pivot points of the first and second body segments;

a second coupling device coupling the remaining pivot point of the second body segment to one of the pivot points of a third body segment, wherein each coupling device allows each individual body segment to be selectively rotated relative to another individual body segment to form a first shape.

10. The athletic training aid of claim 9, further comprising a stabilizer configured to be detachably coupled to at least one of the plurality of body segments, wherein the stabilizer is configured to secure the athletic training aid to a surface.

11. The athletic training aid of claim 10, wherein the stabilizer comprises a garden staple.

12. The athletic training aid of claim 9, wherein each coupling device further comprises a through hole to create an opening through the pivot points of the plurality of body segments.

13. The athletic training aid of claim 9, wherein the plurality of body segments comprises a flexible material.

14. The athletic training aid of claim 9, wherein the plurality of body segments comprises a fabric.

15. The athletic training aid of claim 9, wherein:

the first body segment comprises a first length; and the second body segment comprises a second length that is different from the first length.

16. The athletic training aid of claim 9, wherein the first and second coupling device comprises a grommet.

17. The athletic training aid of claim 9, wherein at least one of the upper surface and the lower surface comprises a set of markings.

* * * * *